US005572990A

United States Patent [19]

Berlin

[11] Patent Number: 5,572,990

[45] Date of Patent: Nov. 12, 1996

[54] RESPIRATORY MASK AND MICROPHONE MOUNT FOR USE THEREIN

[76] Inventor: Florence Berlin, 1C Rue Beau Site, CH-1203 Geneva, Switzerland

[21] Appl. No.: 455,065

[22] Filed: May 31, 1995

[30] Foreign Application Priority Data

Jun. 8, 1994 [DE] Germany ..... 9409320 U

[51] Int. Cl.[6] ..... A62B 18/08

[52] U.S. Cl. ..... 128/201.19; 128/201.23

[58] Field of Search ..... 128/201.19, 201.22, 128/201.23, 201.24, 201.28; 367/901; 381/158, 71, 73.1, 169

[56] References Cited

U.S. PATENT DOCUMENTS

| | | | |
|---|---|---|---|
| 3,092,105 | 6/1963 | Gabb | 128/201.23 |
| 3,680,556 | 8/1972 | Morgan | 128/142.2 |
| 4,594,695 | 6/1986 | Garconnat et al. | 367/135 |
| 4,672,674 | 6/1987 | Clough et al. | 381/71 |
| 4,718,415 | 1/1988 | Bolnberger et al. | 128/201.19 |
| 4,736,740 | 4/1988 | Parker et al. | 128/201.19 |
| 5,046,103 | 9/1991 | Warnaka et al. | 381/71 |
| 5,136,555 | 8/1992 | Gardos | 367/132 |
| 5,307,793 | 5/1994 | Sinclair et al. | 128/201.19 |
| 5,329,593 | 7/1994 | Lazzeroni et al. | 381/168 |
| 5,381,473 | 1/1995 | Andrea et al. | 379/387 |

FOREIGN PATENT DOCUMENTS

| | | | |
|---|---|---|---|
| 31 27 677 | 7/1981 | Germany . | |
| 31 53 678 | 7/1981 | Germany . | |
| 33 42 063 | 11/1983 | Germany . | |
| 34 46 771 | 12/1984 | Germany . | |
| 3921307 | 6/1989 | Germany . | |
| 61-45638 | 3/1986 | Japan . | |
| 288596 | 12/1986 | Japan | 381/169 |

*Primary Examiner*—Edgar S. Burr
*Assistant Examiner*—Daniel J. Colilla
*Attorney, Agent, or Firm*—McCormick, Paulding & Huber

[57] ABSTRACT

A respiratory mask with an inner mask for covering the mouth and nose. The inner mask includes an inhalation valve, an exhalation valve and a voice aperture. A microphone mount is removably attached above the voice aperture. Two microphones are attached with one oriented toward the mouth and the other oriented toward the inhalation valve. The directional patterns of the first and second microphones are respectively perpendicular and parallel to the inside of the microphone mount. The mount takes the form of a signal printed circuit and replaces the conventional voice diaphragm of the mask.

35 Claims, 4 Drawing Sheets

41
37
42
22
24
44
39
62
10
26
28
A
52
36
56
54
58
50
B
46
48
34
17
32
30
16
40
38
B 41
37
42
22
24
44
39
62
52
10
36
26
54
56
58
C
50
46
28
48
34
17
32
30
40
38
16

RESPIRATORY MASK AND MICROPHONE MOUNT FOR USE THEREIN

BACKGROUND OF THE INVENTION

1. Field of the Invention

This invention relates to a respiratory mask having an inner mask for covering mouth and nose, wherein the inner mask has at least one inhalation valve, an exhalation valve and a voice aperture intended to be placed opposite the mouth and in which there is located in the inner mask at least one microphone connectable to a transceiver apparatus or an intercom. The invention relates further to a microphone mount for use in such respiratory mask.

2. Description of the Prior Art

A respiratory mask having an inner mask which covers mouth and nose is known from DE 26 43 853 B2. Such respiratory masks connect the mask wearer to a breath protection equipment, as for example a filter insert or a recirculating device. Respiratory masks, in which the inhaled air is first ducted via a first inhalation valve in the form of a check valve into an outer mask cavity located outside the inner mask and then is ducted to the breathing passages via at least one additional inhalation valve in the form of a check valve through an inner mask cavity located inside the inner mask, are referred to as scavenging masks. The exhaled air is ducted directly from the inner mask to the outside via an exhalation valve in the form of a check valve. In such a scavenging mask there therefore exist separate paths for conducting inhaled and the exhaled air. The first inhalation valve, which leads into the outer mask cavity, is positioned above a voice aperture in the inner mask cavity, which becomes positioned opposite the mouth. The voice aperture is covered by a voice diaphragm on that side which faces the inner mask cavity. When the mask wearer speaks, the voice diaphragm is set into oscillation, whereby the speech is transferred to the outside. With the respiratory mask in place, drawn-in inhaled air flows through the first inhalation valve above the voice aperture into the outer mask cavity and from there is led, as determined by the configuration of the inner mask, past a mask window through at least the second inhalation valve into the inner mask. There it flows toward the air passages of the mask wearer. The exhaling to the outside takes place through the exhalation valve provided in the chin region of the mask. This kind of breathing air ducting is accompanied by high noise production. This noise production has hardly any harmful effect on the operation of the voice diaphragm. However, currently it is desired to equip such respiratory masks with a microphone so that the mask wearer while on duty can also communicate over greater distances with other persons, a control post or the like. In that case, the breathing noise which is produced is extremely harmful to the voice reproduction.

From DE 33 42 063 A 1 there is known a respiratory mask of the kind defined in the introducing part of the specification, in which a microphone is positioned in the inner mask cavity and is connected to a transceiver apparatus or the like through a microphone connecting conductor which is led to the outside in sealed manner through one of the fittings located in the body of the respiratory mask, such as the support for the exhalation valve. In so doing, the microphone is attached to the interior of the inner mask right next to the exhalation valve. By this arrangement of the microphone, there is supposed to be achieved not only an excellent quality of reproduction but sealing difficulties are also supposed to be avoided. But nowadays, the reproduction quality of such an arrangement of the microphone is no longer considered to be satisfactory. The high noise production caused by the air flowing through the in- and exhalation valves has too disturbing an effect on the reproduction. From DE 33 42 063 A 1 it can also not be determined with what type of mount the microphone is attached to the inside of the inner mask.

From U.S. Pat. No. 4,737,740 there is known a gas mask with microphone in which the microphone is located in the inside in a manner similar to that of the respiratory mask according to DE 33 42 063 A 1, but in addition there is also provided a voice diaphragm like that of the respiratory mask according to DE 26 43 853 B2. In addition to the high noise production, which is caused by the air flowing through the in- and exhalation valves, noises from outside are transmitted into the inside of the gas mask through the voice diaphragm, whereby the tonal quality of the microphone is still further degraded.

Finally, from U.S. Pat. No. 5,307,793 there is known a respiratory mask with microphone in which the effect on the microphone of the air noise produced during in- and exhaling is precluded with the aid of mechanical devices which disconnect or cover the microphone during the breathing process. This is a costly method of improving the tonal quality of the microphone. Moreover this method requires a specially constructed respiratory mask so that other respiratory masks, which do not have the same construction, can not be retrofitted according to this method.

SUMMARY OF THE INVENTION it is a task of the invention to provide a respiratory mask in which the voice reproduction is significantly improved. Furthermore, there is to be provided an improved microphone mount which is suitable for use in such a respiratory mask.

This task is achieved in accordance with the invention by a respiratory mask characterized in that in an inner mask a microphone mount is removably attached above a voice aperture. On the inside of the microphone mount a first directional microphone is so attached that when the respiratory mask is worn it is positioned opposite the mouth and is oriented substantially toward same. On the inside of the microphone mount a second directional microphone is spaced from the first microphone and is so attached that it is oriented substantially toward an inhalation valve, and the two microphones are so located in relation to each other and in relation to the microphone mount and so oriented that both microphones pick up ambient noise, but that the first microphone favors speech pick-up over ambient noise.

When a respiratory mask according to the invention is put on, one of the directional microphones is located precisely opposite the mouth, toward which it is also oriented. In older that the voice reproduction is worsened as little as possible by the breathing air flowing through the check valves and through the mask cavities, in accordance with the invention two directional microphones are so attached in the inner mask that one of the microphones favors the pick-up of speech more than the other microphone. Furthermore, by so doing, the respiratory mask can be combined in simple manner with a transceiver apparatus, an intercom, or the like, in order to be able to be switched on for transmission by voice activation. Through the protected location of the microphones in the interior of the respiratory mask the need for shock proof microphones is also eliminated.

When used in a respiratory mask, the microphone mount according to the invention can simply replace the voice diaphragm which is otherwise placed over the voice aperture. To that end there merely needs to be unscrewed a collar by means of which the voice diaphragm is attached to a connecting projection from the voice aperture. The voice diaphragm is replaced by the microphone mount according to the invention which is in the form of a circular, rigid plate and the collar is screwed back on. A connecting cable is simply pulled through a grille which covers the outside of the aperture in conventional manner. The microphone mount according to the invention is very easy to disassemble, e.g. for cleaning the inner mask, or the entire respiratory mask.

Advantageous embodiments of the invention constitute the subject of the dependent claims.

If the arrangement of the two microphones is such that the directional pattern of the first microphone is perpendicular to the inside of the microphone mount and the directional pattern of the second microphone is parallel to the inside of the microphone mount, then the orientation of the two microphones can be made such that the first microphone favors the speech as compared with the second microphone which picks up primarily noise caused by the flow of breathing air.

If, in a further embodiment of the invention, the microphone mount is made circular and covers the voice aperture completely on the inside, then, in a still further embodiment of the invention, it can replace a voice diaphragm which conventionally covers the voice aperture, or it can be located over a voice diaphragm which conventionally covers the voice aperture.

If the microphone mount according to the invention is a printed circuit board to whose conductors the microphones are connected, then the connection of the microphones and of electronic components can be made on the inside of the printed circuit board, whereas the connecting cable connection can be made on the outside. If the microphone mount is built into the respiratory mask in place of the voice diaphragm, the microphones are reliably protected from external influences and the connecting cable can, as mentioned, be brought to the outside through the covering grille of the voice aperture. In this manner, sealing problems, such as are mentioned in the previously noted DE 33 42 063 A 1, are avoided in a simple manner. According to DE 33 42 063 A1, the microphone connections are brought to the outside in a complicated manner through a seal in one of the fittings provided in the mask body, such as the mount for the exhalation valve, the filter mounting or the like, in order to be connected to apparatus located outside the mask, such as an amplifier which drives a loudspeaker. For this purpose there is provided a special lead-through for the microphone connections which can be sealed by a sealant, or else lead-through connections are embedded in the fittings provided in the mask body to which the microphone leads can be connected on the in- and outside of the mask body. The lead-through connections can also be made as connecting plugs in the fittings on the in- and/or outside of the mask body for the connecting leads to the microphone, amplifier, or the like or can be provided with such plugs. All these embodiments of the respiratory mask according to DE 33 42 063 A 1 require substantial modification of the mask body structure. In contrast, the microphone mount according to the invention simply replaces, in the respiratory mask according to the invention, the voice diaphragm, if a connecting cable is to be brought out of the respiratory mask, without any sealing problems arising.

In further elaboration of the microphone mount according to the invention, suitable microphones are electrostatic miniature microphones having a hypercardioid directional pattern. Both microphones receive noises caused by the breathing air which are processed in phase opposition in order to separate speech from noise and thereby cause the voice actuation of a transceiver apparatus, an intercom system or the like, and further improve the voice reproduction.

For the above-mentioned purpose, it is particularly advantageous that, in accordance with the invention, the two microphones are spaced apart and located diametrically opposite each other on the inside of the microphone mount and so oriented that their directional patterns are perpendicular to each other.

The electronic components provided in a still further embodiment of the microphone mount according to the invention can involve a filter or a voice relay, in order to pretreat the microphone signals and obtain a desired voice activation.

BRIEF DESCRIPTION OF THE DRAWINGS

Illustrative embodiments of the invention are described in more detail in what follows with reference to the accompanying drawings. There is shown in FIG. 1 a respiratory mask according to the invention in combination with a protective helmet to whose lower rearward edge there is removably attached a U-shaped transceiver apparatus, whose microphone connecting conductor leading to the respiratory mask is shown only partially, FIG. 2 a cross-section through the respiratory mask according to FIG. 1, FIG. 3 the same cross-sectional view of the respiratory mask as in FIG. 2, but in its worn state in order to illustrate the relationship between microphones and mouth of the mask wearer, or rather the inhalation valve of an inner mask, and FIG. 4 a microphone mount used in the respiratory mask according to FIG. 1 with two microphones, in a plan view of the inside of the microphone mount.

DESCRIPTION OF THE PREFERRED EMBODIMENT

Figure 1:
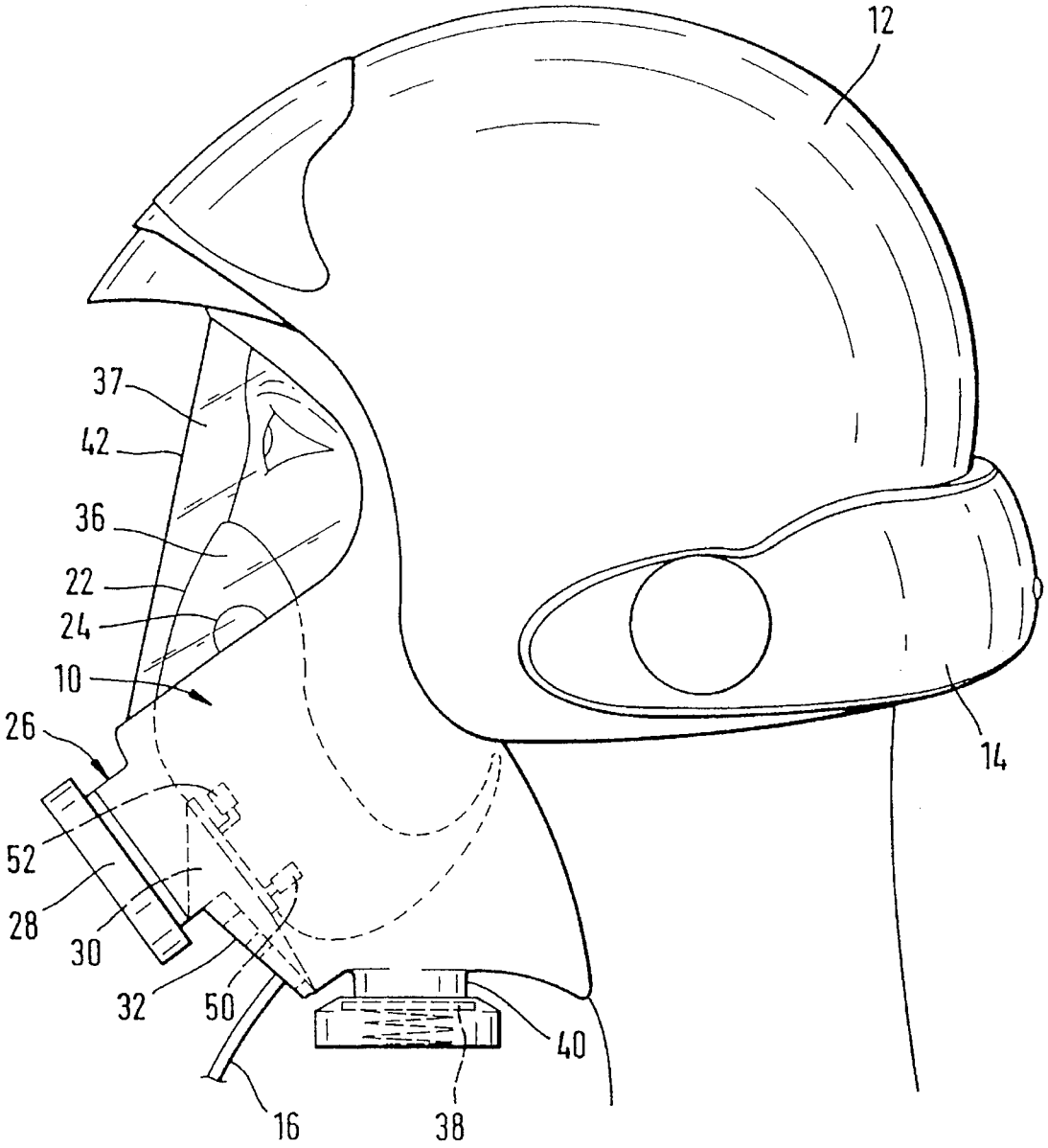
Figure 2:
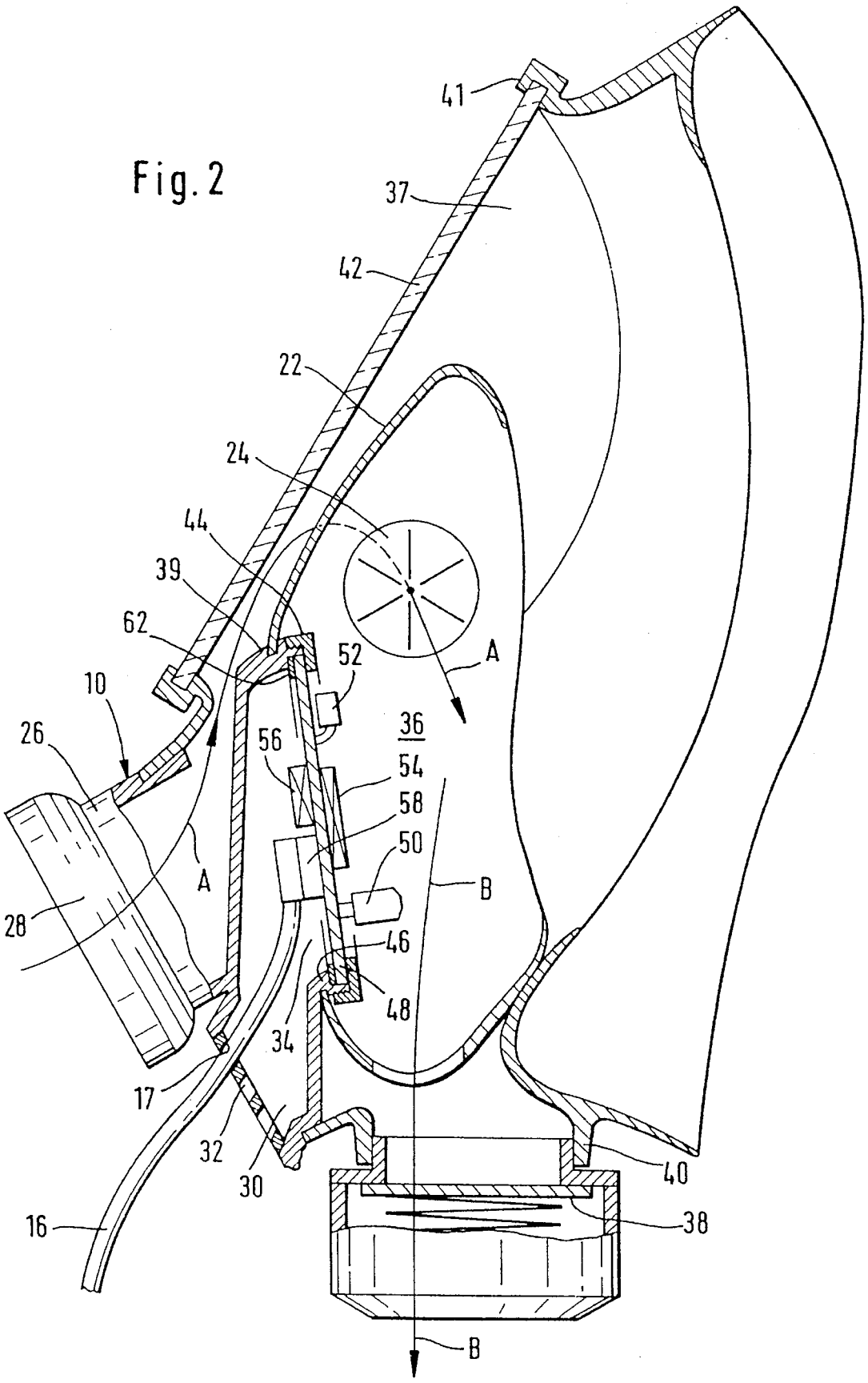
Figure 3:
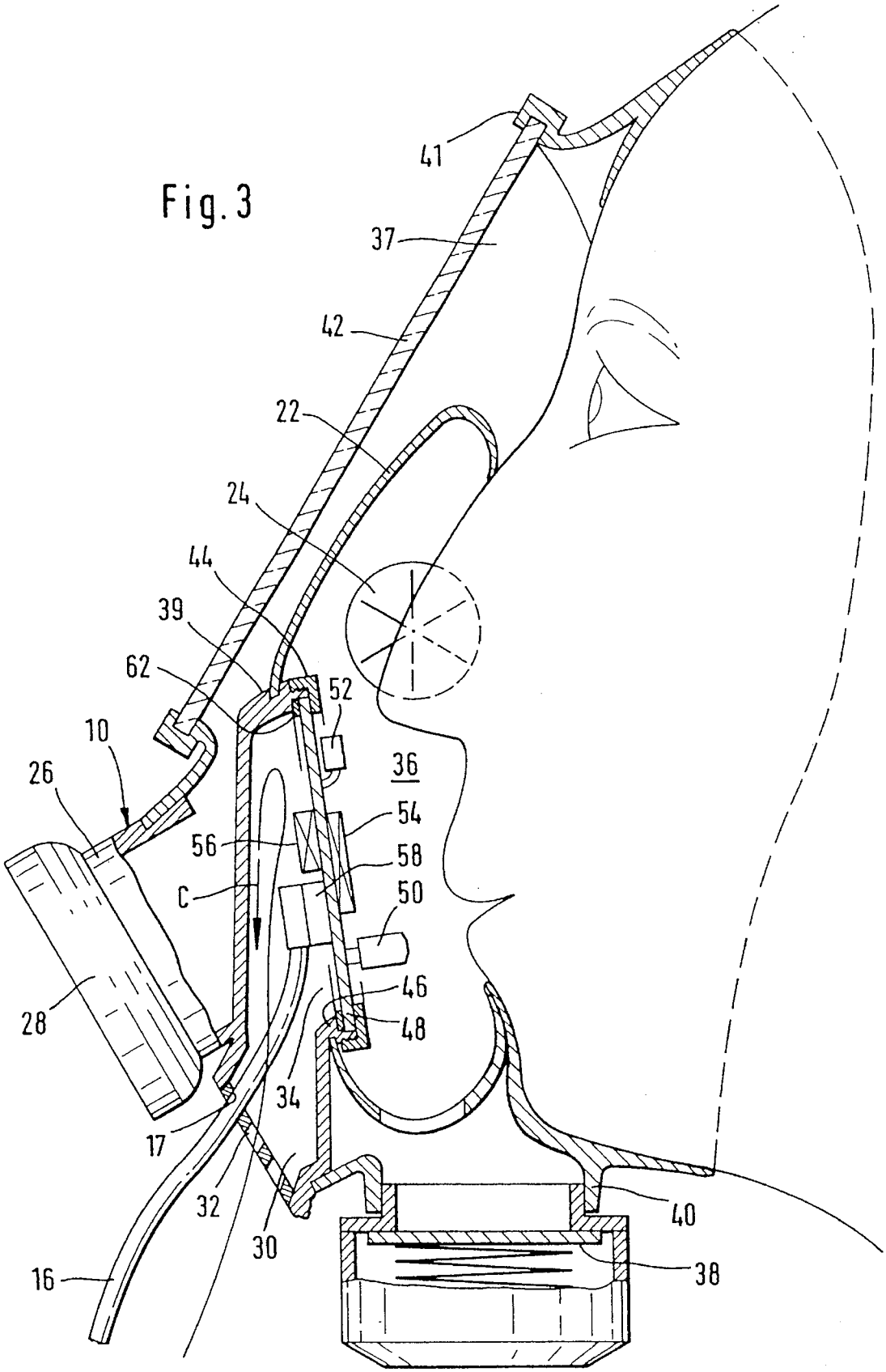
Figure 4:
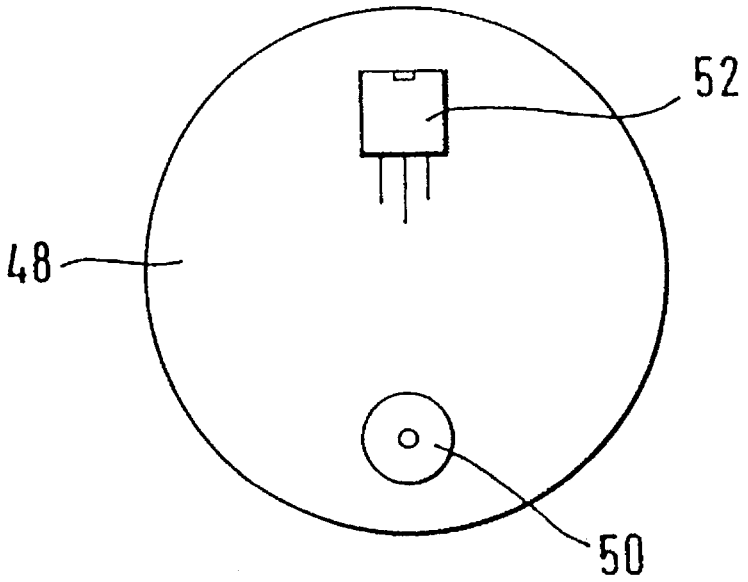

FIG. 1 shows a respiratory mask 10 in combination with a protective helmet 12, to whose lower rearward edge a U-shaped transceiver apparatus 14 is removably attached, and whose microphone connecting conductor 16 leading to the respiratory mask 10 is only partially illustrated. FIG. 2 shows a cross-section through the respiratory mask 10 according to FIG. 1. FIG. 3 shows the same cross-sectional view of the respiratory mask 10 as in FIG. 2, but in its worn state, in order to illustrate the relation between a first microphone 50 and a second microphone 52 and the mouth of a mask wearer or rather an inhalation valve 24 provided for an inner mask 22.

The respiratory mask 10 contains the inner mask 22 in order to separate the breathing paths from each other. A connecting member 26 of the respiratory mask 10 includes an air inlet projection 28 with an additional inhalation valve that is not shown which, like the inhalation valve 24, is built as a check valve. Below the air inlet projection 28 the connecting member 26 has a voice channel 30 which is covered on the outside by a grille 32 and toward the inside is in communication through a voice aperture 34 with an inner mask cavity 36 inside the inner mask 22. At its inner end, the connecting member 26 supports the inner mask 22 which is snapped onto a connecting piece 39 via voice aperture 34, or is otherwise attached thereto in sealed fashion and removably. The inner mask cavity 36 is connected directly to the outside through an exhalation valve 38.

As is conventional, the exhalation valve 38 is also a check valve. As is conventional, the inhalation valve 24 is present twice (viewed from the front to the left and to the right of the nose of the mask wearer), but in FIG. 2 and 3 only one of these two inhalation valves is visible. The exhalation valve 38 is connected via a connecting piece 40 to the body of the respiratory mask 10. The exhalation valve 38 is located at the lowest point in the inner mask cavity 36. On its front, the respiratory mask 10 is provided as usual with a mask window 42 which is sealed to the mask body by a connection 41.

As is usual the voice aperture 34 is covered by a voice diaphragm (not illustrated) which is attached by means of an illustrated collar 44 provided with internal threads to a connecting piece 46 provided with external threads and surrounding the voice aperture 34. When respiratory mask 10 is put on, the voice diaphragm (not shown) is positioned opposite the mouth of the mask wearer. When the latter speaks, he sets the voice diaphragm into oscillations which transmit the speech outwardly to a person in the vicinity. Thus voice communication is possible only over very short distances and with low reproduction quality.

In the respiratory mask 10 here described the voice diaphragm has therefore been replaced by a rigid plate which includes, in the illustrative example shown, a printed circuit board 48 with printed conductors. For sealing, there is inserted between a shoulder of the connecting piece 46 and the outside of the printed circuit board 48 an elastic sealing ring 62. The printed circuit board 48 is preferably a printed circuit board provided with conductors on both sides and made of glass fiber reinforced epoxy and constitutes a microphone mount which supports on its inner side, i.e. on its side facing the inner mask cavity 36, the first microphone 50 and the second microphone 52 which are connected to the conductors of printed circuit board 48. In addition the printed circuit board 48 can support electronic components 54, 56 which are also connected to the conductors. The function of these electronic components is further explained below. Finally, the printed circuit board 48 is provided with a supply cable connection 58 in the form of a plug which is plugged into a socket connected to the printed circuit conductors. From this connection 58 the microphone connecting conductor 16 leads to the transceiver apparatus 14 which provides a radio link to a control post, another mask wearer, or the like.

In the illustrated embodiment, the supply cable connection 58 is located on the outside of the printed circuit board 48. The arrangement could also be such that the supply cable connection 58 and the electronic component 56 are also placed on the inside of the printed circuit board 48. In that case, the microphone mount 48 can simply be located as an add-on over the voice diaphragm (not shown). However, in that case the lead-out of connecting conductor 16 from the inner mask 22 would require a special seal, which is avoided by the embodiment illustrated in which the connecting conductor 16 is led out simply through an opening 17 in the grille 32 or in the mask body adjacent to the grille (e.g. at mask window 42). In the illustrated case, the microphone mount takes the form of a circular printed circuit board and completely covers the voice aperture 34 on the inner side toward the inner mask cavity 36. If the voice diaphragm is not removed, but the printed circuit board 48 forming the microphone mount is located over the voice diaphragm, the microphone mount would not need to completely cover the voice aperture 34 because in that case the voice diaphragm would still provide the cover and seal. In that case, the microphone mount could also be made as a sort of star of spokes, or any other discontinuous configuration, which would only serve the function of mounting the two microphones 50, 52 but would have no sealing function. In that case, the mask wearer could communicate additionally via the voice diaphragm with people in the vicinity who wear no respiratory mask at all, or no respiratory mask with wireless voice transmission apparatus.

In the illustrated example, the printed circuit board 48 additionally separates the usually C, which can enter through grille 32 and must not be inhaled, from the inhalation air A inside the respiratory mask 10.

Before describing further the two microphones 50,52 and their positioning there is further described for completeness the path of the breathing air inside the respiratory mask 10. The inhaled air A enters from a filter cartridge or an oxygen bottle into the air inlet projection 28 and flows into an outer mask cavity 37 which is located inside the respiratory mask 10 and outside the inner mask 22. In this outer mask cavity 37, the inhaled air A flows upwardly and past the inside of mask window 42. The inhaled air A then passes through the inhalation valve 24 into the inner mask cavity 36, from where it reaches the breathing passages of the mask wearer. The exhaled air B ultimately reaches the outside through the connection piece 40 and the exhalation valve 38. The flow of inhaled air A and exhaled air B through the inhalation or exhalation valves 24, 38 which are in the form of check valves is accompanied by high noise production.

On the microphone mount in the form of a rigid printed circuit board 48 the two microphones 50,52, which are directional microphones, are so located, spaced apart and diametrically opposite each other, that their directional patterns are perpendicular to each other. This arrangement is such that when respiratory mask 10 is put on, the first microphone 50 is positioned opposite the mouth and is substantially oriented toward same. The directional pattern of the first microphone 50 is perpendicular and the directional pattern of the second microphone 52 is parallel to the inside of printed circuit board 48. The second microphone 52 is oriented substantially upwardly toward the inhalation valve 24, i.e. in the direction toward in the in-flowing inhaled air A. In the illustrated exemplary embodiment, each microphone 50, 52 is an electrostatic miniature microphone having a hypercardioid directional pattern.

The two microphones pick up the breathing noise, whose signal levels at the two microphones 50, 52 are equalized in order to establish the rest condition of the system. In so doing, the position of the two microphones 50, 52 is very important. The second microphone 52 is attached in the upper portion of the inner mask 22. The first microphone 50 is attached perpendicularly thereto low in the inner mask (right or left) at the level of the mouth of the mask wearer and therefore picks up more of the speech signal than the second microphone 52.

Because of the described orientation of the two microphones 50, 52, the first microphone 50 preferentially picks up background noise (noise of the in-flowing inhaled air A) and speech (from the mouth of the mask wearer). In contrast the higher positioned second microphone 52 oriented toward the inhalation valves 24 picks up mainly noise or background noise. The output signals of the two microphones 50, 52 are processed in phase opposition in order to separate the breathing noise from the speech and thereby obtain excellent voice reproduction. When the mask wearer speaks, the first microphone 50 receives a stronger signal than the second microphone 52, and by processing of the output signals of the two microphones 50, 52 in phase opposition, a switching signal is obtained which activates the voice transmission path (i.e. a transmitter) only when the mask wearer starts to speak, as described in further detail below.

When the mask wearer speaks, the lower or first microphone 50 receives a stronger signal than the second microphone which is attached above the nose, whereby the transmitter of the voice transmission path is activated so as to carry out the voice transmission. As long as the mask wearer does not speak, the system remains at rest because the breathing noise, even when it is very strong, does not produce a switching signal to activate the voice transmission path.

Due to their location on the rigid printed circuit board 48 in the inner mask cavity 36, the two microphones 50, 52 are also protected from outside influences. The microphones which are used are of such construction that they tolerate elevated ambient air humidity (of 80 percent). The printed circuit board 48 is very easily detachable to enable cleaning of the inner mask 22 or of the whole respiratory mask 10 (without the printed circuit board 48) in an ultrasonic bath. At this time there are still not known any miniature microphones which can withstand ultrasonic cleaning and the washing medium used therein.

The electronic components 54, 56 serve the purpose of providing inside respiratory mask 10 a first sound signal processing (filtering, signal conditioning and possibly voice activation). These electronic components can be located on the printed circuit board 48, as shown.

The two microphones 50, 52, together with the appropriate accompanying components such as components 54, 56 which are positioned on the printed circuit board 48 itself, or with other such components which are located inside the transceiver apparatus 14, constitute a portion of a voice activated system which can be used not only for respiratory masks as shown, but also for motorcycle safety helmets which are equipped with wireless voice equipment. The voice activation system switches on the wireless voice equipment or the transceiver apparatus only during actual speaking, i.e. when the fireman who is occupied with fire fighting wants to communicate with the control post or the team leader, and vice versa, or when a driving instructor wishes to speak with his motorcycle driving student who wears a safety helmet with wireless voice equipment and vice versa. In general the voice activation system can be used anywhere that highly reliable voice activation and good voice reproduction by the wireless voice equipment is needed, i.e. irrespective of the noise level or the temporary variations in the noise level of the surroundings. As has been explained, this noise level is especially harmful inside respiratory masks. The sound and noise pick-up takes place by means of the two miniature microphones 50, 52 which are each resistant not only to humidity but also to heat. The output signals of microphones 50, 52 are amplified and subsequently pass through band-pass filters in order to suppress undesired frequencies. The signal from microphone 50 which is derived from one of the band-pass filters is supplied to one input of a differential amplifier and specifically with or without phase inversion depending upon the relative position of the two microphones in front of the mask wearer's mouth. The system is internally balanced when both microphones pick up only background noise. As soon as the first microphone 50, i.e. the speech and noise microphone, also picks up speech, the system is unbalanced by the sound of the speech. This is used as a signal to switch on the transmitter of the transceiver apparatus.

The lead-through of microphone connecting lead 16 can take place through a flexible printed circuit, which is located between the mask window 42 and its connection 41 (ordinarily made of neoprene), whereby total sealing is assured. By means of a sealed connecting plug on supply cable connection 58 there is made the connection between the respiratory mask 10 and the microphone connecting lead 16. The plug also makes possible the disassembly of the mini mask for cleaning as described above.

A respiratory mask (10) has been described with an inner mask (22) for covering mouth and nose, wherein the inner mask (22) includes at least an inhalation valve (24), an exhalation valve (38) and a voice aperture (34) which is intended to be placed opposite the mouth. In the inner mask (22) a microphone mount (48) is removably attached above the voice aperture (34). On the inside of the microphone mount (48) two directional microphones (50, 52) are so attached that, when the respiratory mask (10) is put on, one of the microphones (50)is positioned opposite the mouth and is oriented substantially toward it and that the other microphone (52) is oriented substantially toward the inhalation valve (24). The directional pattern of the first microphone (50) is perpendicular and the directional pattern of the second microphone (52) is parallel to the inside of the microphone mount (48). The microphone mount (48) takes the form of a rigid printed circuit board and replaces the currently conventional voice diaphragm of the respiratory mask (10). In this manner there is obtained excellent voice reproduction and a reliable switching signal for voice activation, in order to turn on the voice communication only when speaking is actually taking place. Sealing problems due to a microphone connecting lead (16) which has to be led to the outside are avoided because it is preferably led through a voice channel (30) and a grille (32) which covers same.

I claim:

1. A respiratory mask having an inner mask for covering mouth and nose, wherein the inner mask has at least one inhalation valve, an exhalation valve and a voice aperture to be placed opposite the mouth and in which there is located in the inner mask at least one microphone connectable to a transceiver apparatus or an intercom, characterized in that, in the inner mask a microphone mount is removably attached over the voice aperture, on the inside of the microphone mount a first directional microphone is so attached that when the respiratory mask is worn the first directional microphone is positioned opposite the mouth and the first directional microphone has a directional pattern oriented substantially toward the mouth for picking up ambient noise and speech but favoring speech pick up, on the inside of the microphone mount a second directional microphone is attached and is spaced from the first microphone and has a second directional pattern oriented substantially toward the inhalation valve for picking up mainly ambient noise.

2. Respiratory mask according to claim 1, characterized in that the directional patterns of the microphones are perpendicular to each other.

3. Respiratory mask according to claim 2, characterized in that the directional pattern of the first microphone is perpendicular and the directional pattern of the second microphone is parallel to the inside of the microphone mount.

4. Respiratory mask according to claim 2, characterized in that the microphone mount is of circular shape and completely covers the voice aperture toward the inner mask cavity.

5. Respiratory mask according to claim 2, characterized in that the microphone mount replaces a voice diaphragm which conventionally covers voice aperture.

6. Respiratory mask according to claim 2, characterized in that the microphone mount is located over a voice diaphragm which conventionally covers the voice aperture.

7. A respiratory mask according to claim 2, wherein the microphone mount takes the form of a circular rigid plate dimensioned to replace a voice diaphragm which conventionally covers the voice aperture of the respiratory mask and that first and second directional microphones on the inside of the plate are located spaced apart and diametrically opposite to each other, the first anti second directional microphones having directional patterns being perpendicular to ,each other.

8. Respiratory mask according to claim 1, characterized in that the directional pattern of the first microphone is perpendicular and the directional pattern of the second microphone is parallel to the inside of the microphone mount.

9. Respiratory mask according to claim 8, characterized in that the microphone mount is of circular shape and completely covers the voice aperture toward the inner mask cavity.

10. Respiratory mask according to claim 8, characterized in that the microphone mount replaces a voice diaphragm which conventionally covers voice aperture.

11. Respiratory mask according to claim 8, characterized in that the microphone mount is located over a voice diaphragm which conventionally covers the voice aperture.

12. A respiratory mask according to claim 8, wherein the microphone mount takes the form of a circular rigid plate dimensioned to replace a voice diaphragm which conventionally covers the voice aperture of the respiratory mask and that first and second directional microphones on the inside of the plate are located spaced apart and diametrically opposite to each other, the first and second directional microphones having directional patterns being perpendicular to each other.

13. Respiratory mask according to claim 1, characterized in that the microphone mount is of circular shape and completely covers the voice aperture toward the inner mask cavity (36).

14. Respiratory mask according to claim 13, characterized in that the microphone mount replaces a voice diaphragm which conventionally covers voice aperture.

15. Respiratory mask according to claim 13, characterized in that the microphone mount is located over a voice diaphragm which conventionally covers the voice aperture.

16. A respiratory mask according to claim 13, wherein the microphone mount takes the form of a circular rigid plate dimensioned to replace a voice diaphragm which conventionally covers the voice aperture of the respiratory mask and that first and second directional microphones on the inside of the plate are located spaced apart and diametrically opposite to each other, the first and second directional microphones having directional patterns being perpendicular to each other.

17. Respiratory mask according to claim 1, characterized in that the microphone mount replaces a voice diaphragm which conventionally covers voice aperture.

18. A respiratory mask according to claim 17, wherein the microphone mount takes the form of a circular rigid plate dimensioned to replace a voice diaphragm which conventionally covers the voice aperture of the respiratory mask and that first and second directional microphones on the inside of the plate are located spaced apart and diametrically opposite to each other, the first and second directional microphones having directional patterns being perpendicular to each other.

19. Respiratory mask according to claim 1, characterized in that the microphone mount is located over a voice diaphragm which conventionally covers the voice aperture.

20. A respiratory mask according to claim 19, wherein the microphone mount takes the form of a circular rigid plate dimensioned to replace a voice diaphragm which conventionally covers the voice aperture of the respiratory mask and that first and second directional microphones on the inside of the plate are located spaced apart and diametrically opposite to each other, the first and second directional microphones having directional patterns being perpendicular to each other.

21. A respiratory mask according to claim 1, wherein the microphone mount takes the form of a circular rigid plate dimensioned to replace a voice diaphragm which conventionally covers the voice aperture of the respiratory mask and that first and second directional microphones on the inside of the plate are located spaced apart and diametrically opposite to each other, the first and second directional microphones having directional patterns being perpendicular to each other.

22. A respiratory mask according to claim 21, characterized in that the rigid plate is a printed circuit board with printed conductors.

23. A respiratory mask according to claim 22, characterized in that at least the two microphones and a supply cable connection and electronic components are connected to the conductors of the printed circuit board.

24. A respiratory mask according to claim 23, characterized in that the directional microphones are electrostatic miniature microphones having hypercardioid directional patterns.

25. A respiratory mask according to claim 23, characterized in that the microphones are so attached to the inside of the rigid plate that the directional pattern of the first directional microphone is perpendicular to the plate and the directional pattern of the second directional microphone is parallel to the plate.

26. A respiratory mask according to claim 23, characterized in that the rigid plate is made of glass fiber reinforced epoxy.

27. A respiratory mask according to claim 22, characterized in that the directional microphones are electrostatic miniature microphones having hypercardioid directional patterns.

28. A respiratory mask according to claim 22, characterized in that the microphones are so attached to the inside of the rigid plate that the directional pattern of the first directional microphone is perpendicular to the plate and the directional pattern of the second directional microphone is parallel to the plate.

29. A respiratory mask according to claim 22, characterized in that the rigid plate is made of glass fiber reinforced epoxy.

30. A respiratory mask according to claim 21, characterized in that the directional microphones are electrostatic miniature microphones having hypercardioid directional patterns.

31. A respiratory mask according to claim 30, characterized in that the microphones are so attached to the inside of the rigid plate that the directional pattern of the first directional microphone is perpendicular to the plate and the directional pattern of the second directional microphone is parallel to the plate.

32. A respiratory mask according to claim 30, characterized in that the rigid plate is made of glass fiber reinforced epoxy.

33. A respiratory mask according to claim 21, characterized in that the microphones are so attached to the inside of the rigid plate that the directional pattern of the first directional microphone is perpendicular to the plate and the directional pattern of the second directional microphone is parallel to the plate.

34. A respiratory mask according to claim 33, characterized in that the rigid plate is made of glass fiber reinforced epoxy.

35. A respiratory mask according to claim 21, characterized in that the rigid plate is made of glass fiber reinforced epoxy.

* * * * *